United States Patent [19]

Zack et al.

[11] Patent Number: 4,731,895

[45] Date of Patent: Mar. 22, 1988

[54] HIGH SPEED FLOOR BURNISHING MACHINE

[75] Inventors: Lawrence P. Zack, Minneapolis, Minn.; Gary E. Palmer, Roselle, Ill.

[73] Assignee: Hako Minuteman, Inc., Addison, Ill.

[21] Appl. No.: 922,083

[22] Filed: Oct. 21, 1986

[51] Int. Cl.[4] ..... B24B 29/00; A47L 11/20

[52] U.S. Cl. ..... 15/98; 15/230.17; 15/385; 51/177

[58] Field of Search ..... 15/98, 230, 230.14–230.19, 15/385; 51/177

[56] References Cited

U.S. PATENT DOCUMENTS 4,322,920 4/1982 Wells ..... 15/230.17
4,365,377 12/1982 Todd et al. ..... 15/98
4,485,519 12/1984 Collier ..... 15/385
4,598,440 7/1986 Wilson ..... 15/98
4,631,775 12/1986 Palmer et al. ..... 15/98 X

*Primary Examiner*—Edward L. Roberts
*Attorney, Agent, or Firm*—Emrich & Dithmar

[57] ABSTRACT

A pad driver assembly for a high speed floor burnishing machine includes a flexible or semi-rigid backing member with a pad beneath it and gripping projections for holding the pad in place. The backing member is provided with apertures so that when the pad assembly is driven at high rotational velocities beneath a shroud, air is drawn in through the apertures and forced radially outward in the pad, increasing the gripping action between the gripping projections and the pad, and also increasing the downward atmospheric pressure on the peripheral portion of the pad to promote increased polishing effectiveness.

5 Claims, 4 Drawing Figures

HIGH SPEED FLOOR BURNISHING MACHINE

FIELD OF THE INVENTION

The present invention relates to floor polishers or burnishers; and more particularly, it relates to high speed floor burnishers. As used herein, "high speed" refers to rotary burnishing machines wherein the burnishing pad is rotated at an angular velocity of 1,000 RPM or greater. Typically, such machines operate at angular velocities of 1800 to 2000 RPM or more. The present invention is concerned with improvements to a high speed floor burnisher of the type disclosed in co-owned, copending U.S. patent application Ser. No. 807,679, filed Dec. 11, 1985, entitled IMPROVEMENTS IN HIGH SPEED FLOOR BURNISHER.

BACKGROUND AND SUMMARY OF THE INVENTION

In high speed floor burnishing machines of the type with which the present invention is concerned, an electric motor drives a pad driver assembly which includes the floor burnishing pad at high angular velocities. Because the pad is driven in rotation, and because the pad is made of a very loosely woven fiber-like material and is highly permeable to the flow of air, there are centrifugal forces which tend to cause the material of the pad to "creep"—i.e., to move out from beneath the flexible backing plate which holds it. In this connection, the term "flexible" means that the material of the backing member is semi-rigid, but will normally flex under usage or can be flexed or bent with the hands.

The pad itself is held in place by teeth or projections beneath the backing member, and at least one improvement, described in the above-identified copending application, provides a retaining skirt or flange on the periphery of the backing member to help restrain pad creep.

Although these measures have extended the useful life of the pad by some measure, there nevertheless is room for improvement in that some pads are being discarded because they have lost their shape rather than because they have lost their ability to polish.

Briefly, the present invention provides for a plurality of apertures in the backing member as well as the gripping element. These apertures are spaced at equal angular increments about the backing member and at intermediate locations between the axis of rotation and the outer peripheral edge of the backing member. When the pad driver assembly is rotated at high speed, the apertures in the backing member permit air to flow downwardly into the pad itself. Because the pad is rotating at high angular velocity, the air is forced radially outwardly at an accelerating rate, thereby creating a slight vacuum beneath atmospheric pressure. Atmospheric pressure causes the outer peripheral portion of the backing member and the gripping element to press downwardly onto the pad material. This has the dual effect of causing the gripping element to engage and hold the pad material more effectively, thereby reducing the tendency of the pad material to creep, and it also applies pressure on the peripheral area of the pad which has the greatest burnishing effect because of the higher pad speed in that area.

Other features and advantages of the present invention will be apparent to persons skilled in the art from the following detailed description of a preferred embodiment accompanied by the attached drawing wherein identical reference numerals will refer to like parts in the various views.

DESCRIPTION OF THE PREFERRED EMBODIMENT

Figure 1:
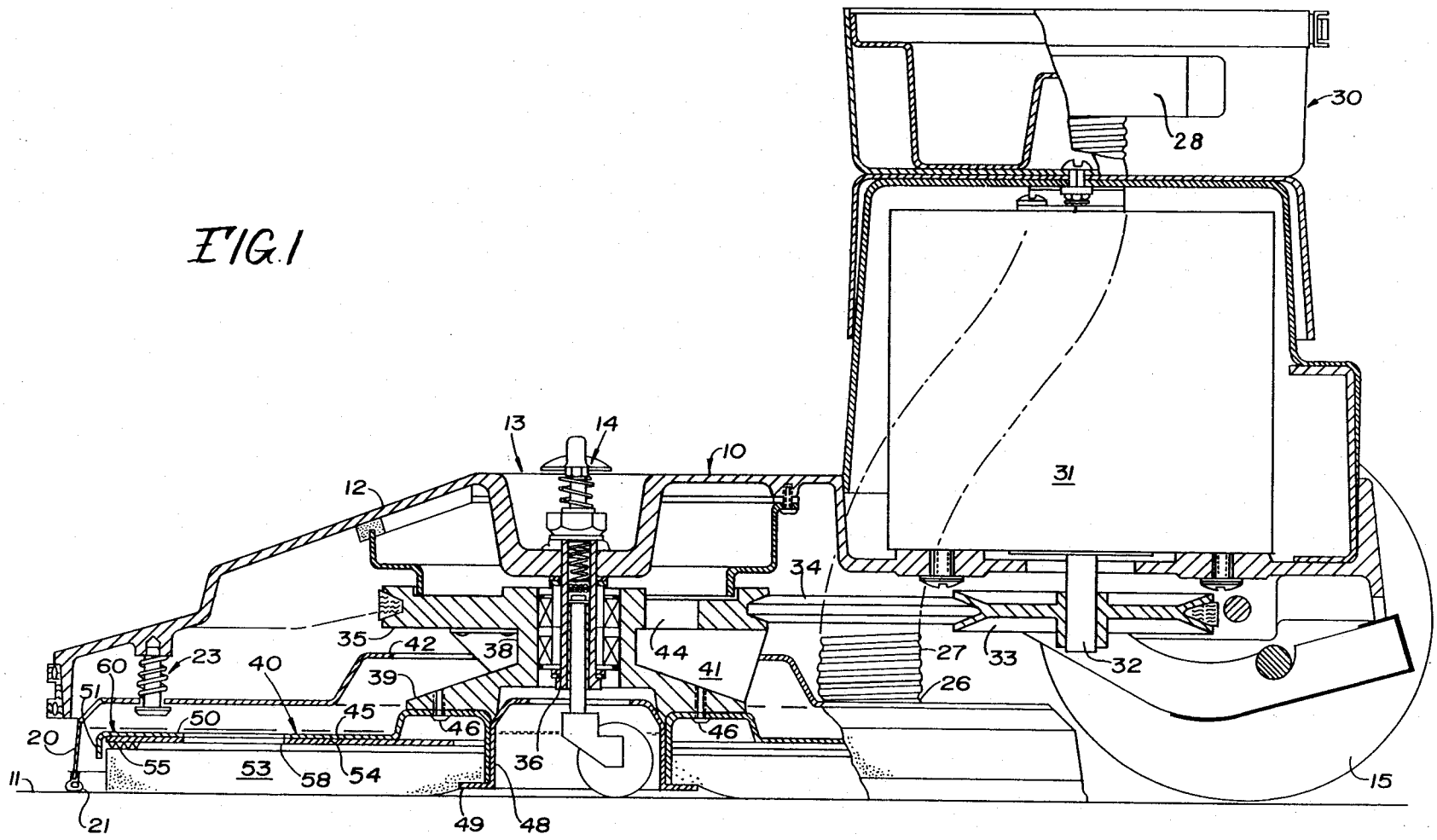
FIG. 1 is a vertical cross-sectional view of a burnishing machine incorporating the features of the present invention, taken along the fore-to-aft center line of the machine.

The present invention incoporates improvements to a floor burnishing machine such as is disclosed in co-owned, co-pending U.S. application of Todd and Palmer, Ser. No. 807,679, filed Dec. 11, 1985 for IMPROVEMENTS IN HIGH SPEED FLOOR BURNISHER. Thus, many of the details of the machine need not be disclosed further for an appreciation of the present improvements.

Referring now to the drawing, there is illustrated a high speed floor burnishing machine, generally designated by the numeral 10, for use in polishing or burnishing a floor represented by the horizontal line 11. The machine 10 includes a housing 12 which has a centrally located recess 13 in the top portion for mounting a caster wheel assembly 14, which is conventional. The housing 12 is supported for movement along the floor 11 by a pair of coaxial wheels 15 mounted rearwardly of the housing 12. There is also provided a handle (not shown) operatively connected to the housing 12 so that the user of the machine can propel and control it as desired.

A vacuum shroud 20 is suspended beneath the housing 12 and has a circular lower edge provided with a flexible floor seal 21 disposed in use in sealing engagement with the floor 11. The shroud 20 is suspended from the housing 12 by a plurality of spring mounts, such as the one illustrated at 23, so that the vacuum shroud 20 is mounted for independent movement relative to the housing 12. The shroud 20 defines a chamber and is provided adjacent to the rear end thereof with an upwardly extending discharge portion 26 which communicates with conduit 27, which in turn communicates with a fitting 28 which leads into a collection and filter assembly generally designated 30.

Mounted above the housing 12 is an electric motor 31 having an output shaft 32 coupled to a pulley 33 which drives a belt 34 connected in turn to a pulley 35. The pulley 35 is journalled on a shaft 36 which is fixed in the center of the well 13 of housing 10 and receives the center caster assembly 14.

Figure 2:
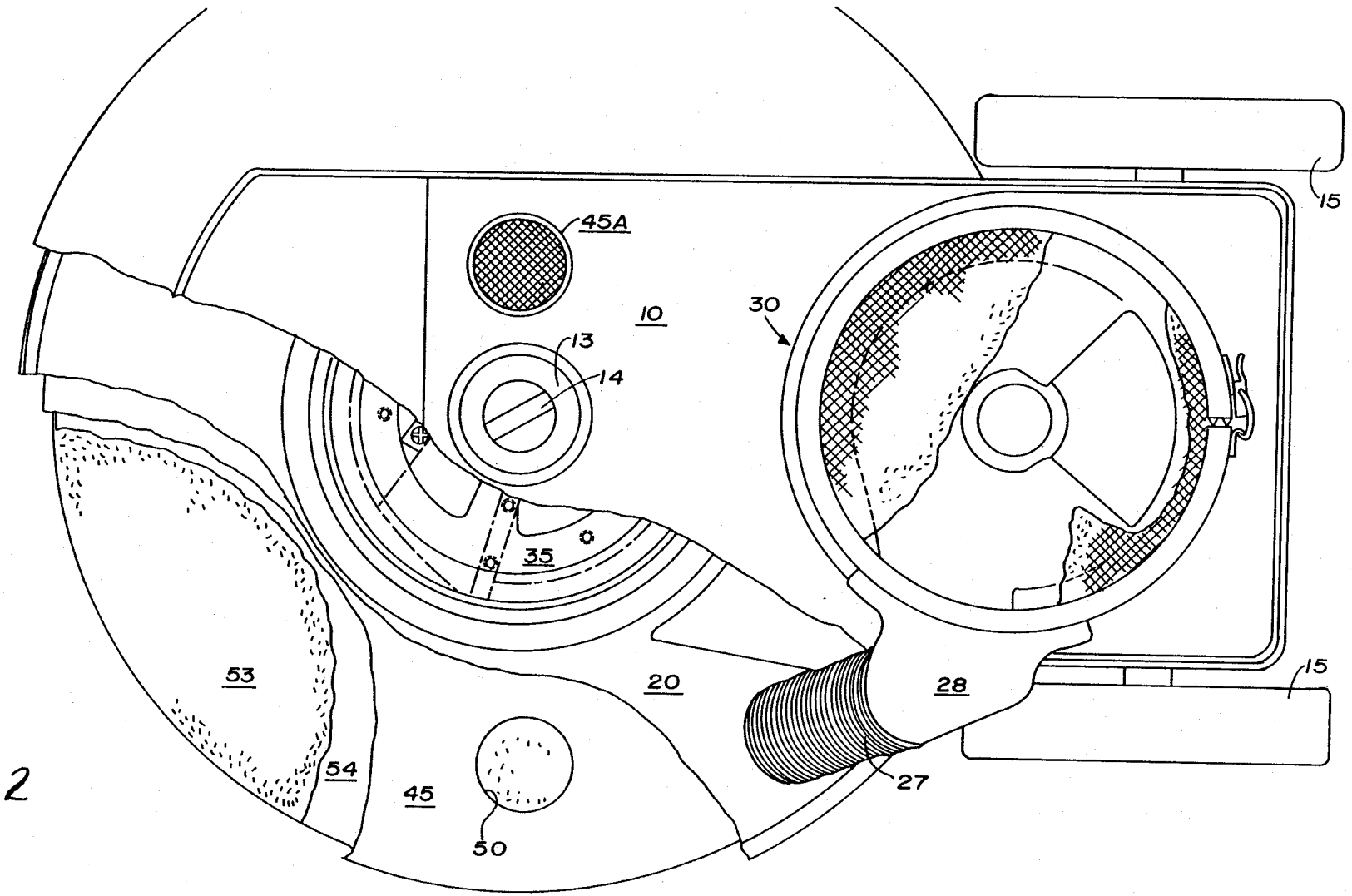
FIG. 2 is a plan view of the machine of FIG. 1 with portions broken away to show features of the construction more clearly.

The pulley 35 is a casting which includes a downwardly extending central portion 38 which is outwardly flanged at 39 for mounting a pad driver assembly generally designated 40. A plurality of radially extending fins such as that designated 41 may be formed in the pulley 35; and apertures such as that designated 44 may also be formed in the pulley 35 to permit air to flow downwardly from beneath the central portion of the housing 12, where it enters through an aperture 45A (FIG. 2). The fins 41 force the air radially outwardly in the space between the shroud 20 and the pad driver 40, the pulley 35 being located in a central aperture 42 in the shroud 20.

The pad driver assembly 40 includes a backing plate 45 of semi-rigid plastic such as ABS and which is mounted by fasteners 46 to the flange 39 of the pulley 35 to rotate therewith. An inverted cup 48 having a laterally outwardly extending flange 49 is press-fitted into a central collar of the backing plate 45. The backing plate 45 also includes a plurality of apertures 50 which may be circular when viewed from the top and are located with their centers at approximately seventy percent of the radius of the pad driver assembly. The backing plate 45 also includes an integral outer depending skirt 51.

The pad driver assembly also includes a flexible burnishing pad 53 located beneath a gripper element 54. The gripper element 54 has formed on its underside a plurality of projections or teeth such as those seen at 55 in the lower left corner of FIG. 1. The teeth 55 typically extend throughout the entire surface of the gripper element 54, but some have been omitted for brevity. The teeth 55 are forced into the upper surface of the pad 53 and cooperate with the retaining flange 51 to restrain the pad 53 by gripping it. Further, the center of the pad 53 is held between the central portion of the gripper member 54 and the flange 49 of the cup 48.

The gripper element 54 is also apertured as seen at 58 with apertures similar in size and location to the apertures 50 in the backing plate 45, and the apertures of the gripper element 54 are in register or alignment with the apertures 50 of the backing plate. Since the primary function of the gripper element 54 is to provide teeth or projections to engage the pad 53, the teeth 55 could be integrally formed on the under side of the backing plate 45 without loss of function.

The pad 53 is a conventional polishing pad, formed of very loosely intertwined fiber-like strands which will withstand the considerable abrasion effect of high speed polishing.

Figure 3:
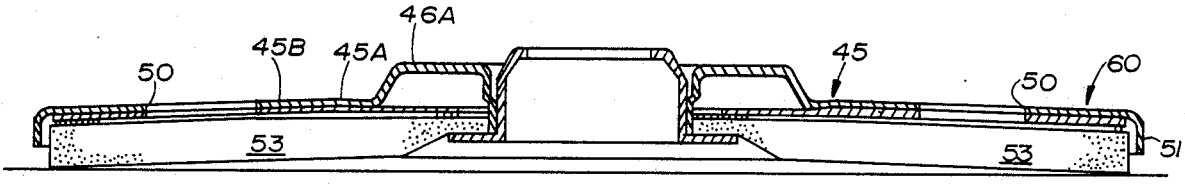
FIG. 3 is a vertical cross-sectional view of the pad driver assembly at rest.

As best seen in FIG. 3, the backing plate 45 preferably may have a slight crown. That is, proceeding radially outwardly from the center, there is a raised mounting surface 46A and a generally horizontal annular section 45A. The outermost annular section 45B is inclined downwardly proceeding further outwardly. In other words, the apex of the circular crown is formed in the illustrated embodiment between the raised mounting portion 46A and the air apertures 50. In operation, the downward pressure on the flexible backing plate 45 causes the crown to flatten out so that the pad 53 engages the floor uniformly, even though most of the burnishing action, as mentioned, occurs in the outer peripheral portion of the pad.

Figure 4:
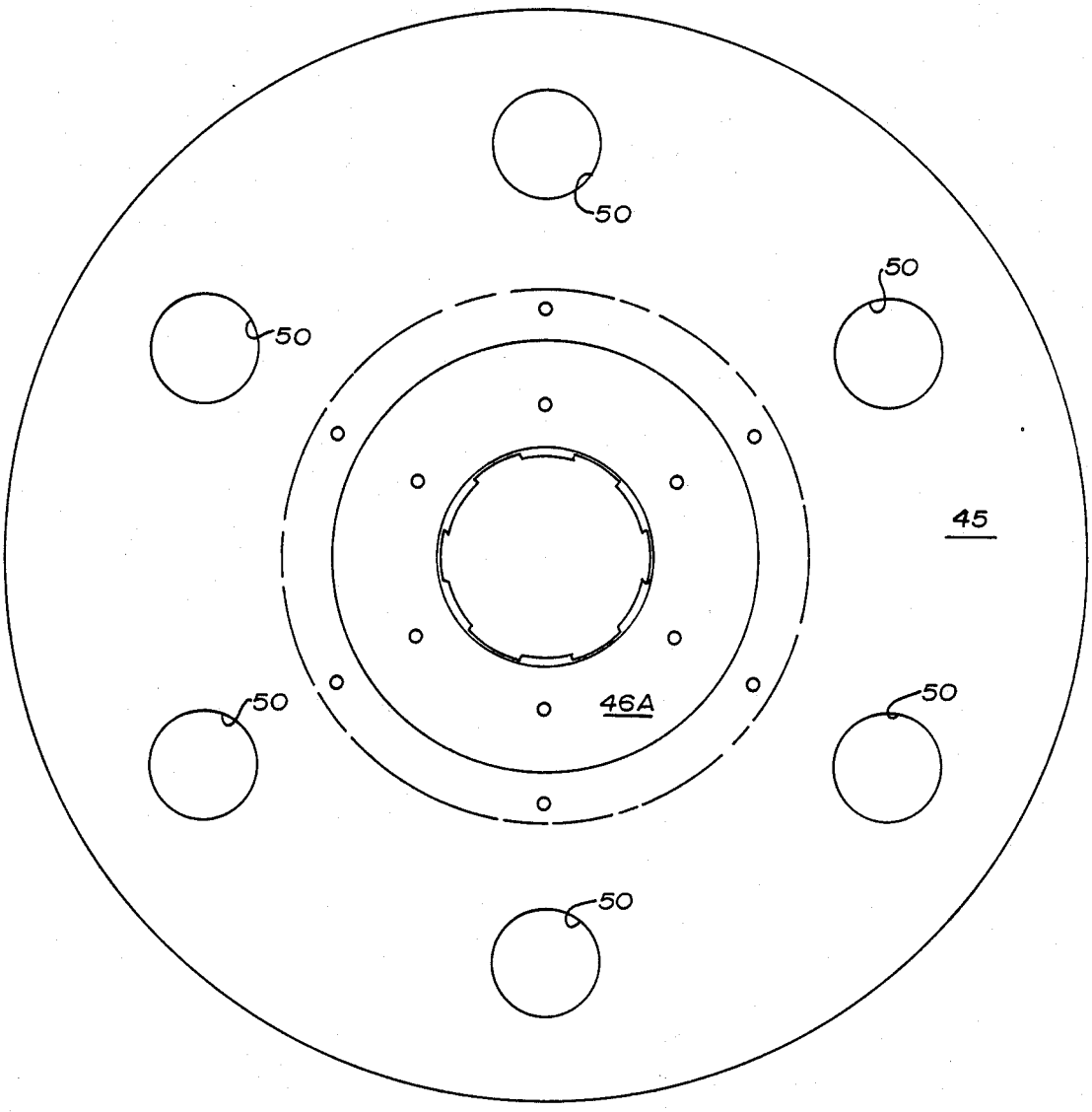
FIG. 4 is a top view of the pad driver assembly.

Turning now to FIG. 4, in the illustrated embodiment, it can be seen that the pad driver assembly includes six of the air passage apertures 50 in the backing plate 45; and they are preferrably spaced at equal angular increments about the backing plate.

In operation, when the motor 31 drives the pulley 35, the pad driver assembly 40 is rotated, the fins 41 establish a radial air flow over the top of the pad driver assembly to force air and any entrained particles or dust in the space between the vacuum shroud 20 and the pad driver assembly through discharge conduit 27 into the filter assembly 30.

Some air enters through the center of the cup 48 and passes radially outwardly through the pad 53, increasing in speed and thereby reducing the pressure at the outer portions of the pad 53. This creates a slight vacuum beneath atmospheric pressure, and atmospheric pressure causes a downward bending of the flexible backing plate 45 and gripping element 54. Still further, air passing above the pad driver assembly enters the apertures 50 in the backing plate and flows through apertures 58 into the gripper and into the highly-permeable pad 53. The high speed angular velocity of the pad 53 causes this latter air to accelerate radially outwardly, thereby increasing the vacuum in the peripheral area of the pad. This has a two-fold effect: First, it causes the atmospheric pressure to exert a greater force on the periphery of the backing plate 45 in the area generally designated by reference numeral 60 in FIG. 1—that is, outwardly of the apertures 50. This, in turn, promotes an even greater downward force on the outer peripheral portion of the pad 53, where the velocity, and thus the burnishing effect, is greatest. Secondly, the downward pressure in the region 60 on the backing plate 45 creates a greater gripping action between the teeth 55 and the pad material 53. The greater gripping action, in cooperation with the flange 51, restrain the pad material from "creep"—that is, from expansion under the centrifugal force of high speed operation.

Persons skilled in the art will appreciate that the two advantages described above resulting from the apertures 50 in the backing plate 45 which permit the introduction of air into the pad 53 at an intermediate location will operate whether or not air is introduced at the center of the pad 53; and we have further found that the flow of air through the vacuum area and conduit 27 into the collection and filter assembly 30 have been greatly increased by the provision of these apertures. In one case, air flow through the pad was increased from 45 to over 110 cfm. Thus, not only is the downward force on the burnishing portion of the pad increased and the gripping action enhanced, but more air is available for evacuating the space beneath the vacuum shroud to carry away entrained dust and debris. If desired, louvers (i.e., raised lids or scoops) can be formed over the apertures 50 to cup air as the driver assembly is rotated to further increase air flow. Further, the size of the apertures and their location are not critical to operation. In the case of a 20 in. pad driver, apertures of 1 in. to $2\frac{1}{4}$ in. in diameter have worked well, although the centers of the apertures should be located at a distance from the axis of rotation greater than half a radius and preferrably about 70% of that distance.

Having thus disclosed a preferred embodiment, persons skilled in the art will be able to modify certain elements of the structure which has been described and substitute equivalent elements for those illustrated while continuing to practice the principle of the invention; and it is, therefore, intended that all such modifications and substitutions be covered as they are embraced within the spirit and scope of the appended claims.

We claim:

1. In a high speed floor burnishing machine, the combination of a pad driver assembly including a flexible backing member, gripping means on the under side of said backing member and a flexible, air-permeable pad coupled to said gripping means, and adapted to contact a surface to be polished; a motor for rotating said pad driver assembly at high angular velocity; shroud means surrounding said pad driver assembly including sealing means for contacting said surface about the periphery of said pad to prevent air and debris from being forced beneath said shroud means; characterized in that said backing member includes a plurality of apertures spaced radially therearound and intermediate the center and periphery thereof, whereby when said pad driver assembly is rotated at high speed, air is drawn down through said apertures and into said pad, and is accelerated radially outwardly of said pad to cause the peripheral portion of said backing member to flex downwardly and thereby to enhance the gripping of said pad about the periphery of said backing member and to generate a greater downward force about the periphery of said pad to increase the polishing effectiveness thereof.

2. The apparatus of claim 1 wherein said pad driver assembly is further characterized in that said backing plate has a crown at an intermediate circumferential location between its center and said apertures and extends slightly downwardly when proceeding outwardly from said crown when said assembly is not being driven.

3. The apparatus of claim 1 wherein said apertures in said backing member are spaced at equal angular increments thereabout and the centers of said apertures are spaced at equal radial distances from the axis of rotation of said pad driver assembly.

4. The apparatus of claim 3 wherein said plurality of apertures comprise circular apertures having their centers located outwardly of the axis of rotation of said pad assembly at a distance of greater than one-half the radial dimension thereof.

5. The apparatus of claim 3 wherein the center of said apertures are located at approximately seventy percent of the radial dimension of said backing member.

* * * * *